US009734748B2

(12) United States Patent
Chen

(10) Patent No.: US 9,734,748 B2
(45) **Date of Patent: *Aug. 15, 2017**

(54) GRAYSCALE VALUE SETTING METHOD FOR LIQUID CRYSTAL PANEL AND LIQUID CRYSTAL DISPLAY

(71) Applicant: SHENZHEN CHINA STAR OPTOELECTRONICS TECHNOLOGY CO., LTD., Shenzhen, Guangdong (CN)

(72) Inventor: Lixuan Chen, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 376 days.

This patent is subject to a terminal disclaimer.

(21) Appl. No.: 14/387,009

(22) PCT Filed: Aug. 22, 2014

(86) PCT No.: PCT/CN2014/085038

§ 371 (c)(1),
(2) Date: Sep. 22, 2014

(87) PCT Pub. No.: WO2016/026147

PCT Pub. Date: Feb. 25, 2016

(65) Prior Publication Data

US 2016/0253949 A1 Sep. 1, 2016

(30) Foreign Application Priority Data

Aug. 18, 2014 (CN) ..... 2014 1 0407363

(51) Int. Cl.

| | |
|---|---|
| ***G09G 5/02*** | (2006.01) |
| ***G09G 3/20*** | (2006.01) |
| ***G09G 3/36*** | (2006.01) |

(52) U.S. Cl.
CPC ..... *G09G 3/2074* (2013.01); *G09G 3/36* (2013.01); *G09G 3/3607* (2013.01);
(Continued)

(58) Field of Classification Search
CPC ..... G09G 3/2074; G09G 3/3607; G09G 3/36; G09G 2360/16; G09G 2320/028;
(Continued)

(56) References Cited

U.S. PATENT DOCUMENTS

2003/0122761 A1* 7/2003 Hong ..... G09G 3/2011 345/89
2006/0109224 A1* 5/2006 Chang ..... G09G 3/003 345/89

(Continued)

FOREIGN PATENT DOCUMENTS

CN 101458914 6/2009
CN 101581864 11/2009

(Continued)

OTHER PUBLICATIONS

International Search Report for PCT/CN2014/085038, English translation attached to original, Both completed by the Chinese Patent Office on May 18, 2015, All together 6 Pages.

*Primary Examiner* — Ke Xiao
*Assistant Examiner* — Kim-Thanh T Tran
(74) *Attorney, Agent, or Firm* — Brooks Kushman P.C.

(57) ABSTRACT

A grayscale value setting method for a liquid crystal panel is disclosed which includes obtaining actual luminance values of each grayscale G of the liquid crystal panel at front and slant view angles; dividing actual luminance values according to the area ratio of the main pixel area M and the sub pixel area S, and establishing corresponding relationships between the grayscale and the actual luminance values in the main and the sub pixel areas; calculating theoretical
(Continued)

luminance values of each grayscale; setting a grayscale combination, such that a sum of difference values between actual and theoretical luminance values of the front and slant view angle are minimal; and repeating the last step to obtain grayscales respectively input to the main pixel and the sub pixel areas at all of grayscales of the liquid crystal panel. A liquid crystal display setting a grayscale value using the above method is also disclosed.

20 Claims, 5 Drawing Sheets

(52) U.S. Cl.
CPC ..... *G09G 2300/0452* (2013.01); *G09G 2320/028* (2013.01); *G09G 2320/0242* (2013.01); *G09G 2320/068* (2013.01); *G09G 2320/0673* (2013.01); *G09G 2360/16* (2013.01)

(58) Field of Classification Search
CPC ..... G09G 2320/068; G09G 2300/0452; G09G 2320/0242; G09G 2320/0673
USPC ..... 345/599
See application file for complete search history.

(56) References Cited

U.S. PATENT DOCUMENTS

| | | | | |
|---|---|---|---|---|
| 2006/0238472 | A1* | 10/2006 | Lee | G09G 3/3688 345/89 |
| 2010/0053052 | A1* | 3/2010 | Shimoshikiryoh | G09G 3/3607 345/89 |
| 2010/0109992 | A1 | 5/2010 | Sumi et al. | |
| 2013/0050618 | A1 | 2/2013 | Lo et al. | |
| 2014/0240305 | A1* | 8/2014 | Chae | G09G 3/3225 345/212 |

FOREIGN PATENT DOCUMENTS

| | | |
|---|---|---|
| CN | 101727814 | 6/2010 |
| CN | 102073182 | 5/2011 |
| CN | 102254535 | 11/2011 |
| CN | 102568429 | 7/2012 |
| TW | 201332339 | 8/2013 |

* cited by examiner

GRAYSCALE VALUE SETTING METHOD FOR LIQUID CRYSTAL PANEL AND LIQUID CRYSTAL DISPLAY

CROSS-REFERENCE TO RELATED APPLICATION

This application is the U.S. national phase of PCT Application No. PCT/CN2014/085038 filed on Aug. 22, 2014, which claims priority to CN Patent Application No. 201410407363.7 filed on Aug. 18, 2014, the disclosures of which are incorporated in their entirety by reference herein.

TECHNICAL FIELD

The present invention relates to a liquid crystal display, and more particularly to a grayscale value setting method for a liquid crystal panel and a liquid crystal display of setting a grayscale value using the method.

BACKGROUND ART

A liquid crystal display (LCD) is a flat and ultra-thin display apparatus, which is composed of a certain amount of colorful or black-and-white pixels and disposed in front of a light source or a reflection plate. Power consumption of the liquid crystal display is very low, and the liquid crystal display has characteristics such as high image quality, small volume and low weight, which is accordingly highly appreciated and becomes a mainstream of displays. The liquid crystal display has been widely applied to various electronic products, such as a computer apparatus, a mobile phone or a digital photo frame having a display screen, etc., and a wide view angle technology is one of development emphasis of current liquid crystal displays. However, when a side view angle or a slant view angle is excessively large, a color shift phenomenon generally occurs in a wide view angle liquid crystal display.

As for a problem that color shift occurs in the wide view angle liquid crystal display, a 2D1G technology is adopted in current industry to solve the problem. The so-called 2D1G technology indicates that each of pixel units is divided into a main pixel area and a sub pixel area having different areas in a liquid crystal panel, the main pixel area and the sub pixel area in the same one pixel unit are connected to different data lines and same gate lines. Different display luminance and slant view luminance are generated through inputting different data signals (different grayscale values) to the main pixel area and the sub pixel area so as to reduce color shift generated during side viewing or slant viewing. As for a grayscale value of the pixel unit, how to set grayscale values of the main pixel area and the sub pixel area, respectively, so that the combination of grayscale values of the main pixel area and the sub pixel area can reduce color shift while achieving an excellent display effect, is a problem that needs to be solved.

SUMMARY

To this end, the present invention provides a grayscale value setting method for a liquid crystal panel to solve grayscale settings of a main pixel area and a sub pixel area in 2D1G technology.

In order to realize the above purpose, the present invention adopts following technical solutions:

A grayscale value setting method for a liquid crystal panel comprising a plurality of pixel units, each of which comprises a main pixel area M and a sub pixel area S, wherein, an area ratio of the main pixel area M and the sub pixel area S is a:b, the method comprises:

S101 obtaining an actual luminance value Lvα of each grayscale G of the liquid crystal panel at a front view angle α;

S102 obtaining an actual luminance value Lvβ of each grayscale G of the liquid crystal panel at a slant view angle β;

S103 according to the area ratio of a:b of the main pixel area M and the sub pixel area S, dividing the actual luminance values Lvα and Lvβ according to following equations:

$$LvM\alpha:LvS\alpha=a:b, LvM\alpha+LvS\alpha=Lv\alpha;$$

$$LvM\beta:LvS\beta=a:b, LvM\beta+LvS\beta=Lv\beta;$$

wherein, actual luminance values LvMα and LvMβ of each grayscale G of the main pixel area M at the front view angle α and the slant view angle β are obtained, respectively; actual luminance values LvSα and LvSβ of each grayscale G of the sub pixel area S at the front view angle α and the slant view angle β are obtained, respectively;

S104 calculating theoretical luminance values LvGα and LvGβ of each grayscale G of the liquid crystal panel at the front view angle α and the slant view angle β according to actual luminance values Lvα(max) and Lvβ(max) of a highest grayscale max obtained in steps S101 and S102, in conjunction with equations:

$$\text{gamma}(\gamma) = 2.2 \text{ and } \left(\frac{G}{\max}\right)^{\gamma} = \frac{LvG}{Lv(\max)};$$

S105 as for a grayscale Gx in the pixel unit, assuming that grayscales input to the main pixel area M and the sub pixel area S are Gmx and Gsx, respectively, obtaining actual luminance values LvMxα, LvMxβ, LvSxα and LvSxβ according to a result of S103, and obtaining theoretical luminance values LvGxα and LvGxβ according to a result of S104; and calculating following equations:

$$\Delta 1=LvMx\alpha+LvSx\alpha-LvGx\alpha;$$

$$\Delta 2=LvMx\beta+LvSx\beta-LvGx\beta;$$

$$y=\Delta 1^2+\Delta 2^2;$$

and judging:

$$Gmx\geq Gm(x-1), Gsx\geq Gs(x-1);$$

wherein, when the condition Gmx≥Gm(x−1), Gsx≥Gs(x−1) is satisfied and y is minimal, corresponding grayscales Gmx and Gsx are set to be grayscales respectively input to the main pixel area M and the sub pixel area S when the pixel unit is at the grayscale Gx; and

S106 repeating S105 with respect to each grayscale G of the pixel unit, so as to obtain grayscales respectively input to the main pixel area M and the sub pixel area S at all of grayscales of the liquid crystal panel.

The front view angle α is 0°, and the slant view angle β is 30-80°.

The slant view angle β is 60°.

The grayscales of the liquid crystal panel include 256 grayscales from 0-255, wherein the highest grayscale max is grayscale 255.

The obtaining of the actual luminance value Lvα of each grayscale G of the liquid crystal panel at the front view angle α comprises:

obtaining a gamma curve of the liquid crystal panel at the front view angle α; and determining the actual luminance value Lvα according to the gamma curve.

The obtaining of the actual luminance value Lvα of each grayscale G of the liquid crystal panel at the slant view angle α comprises:

obtaining a gamma curve of the liquid crystal panel at the slant view angle β; and determining the actual luminance value Lvα according to the gamma curve.

After step S106, a Gm-Lv relationship curve between the grayscale and the luminance of the main pixel area M and a Gs-Lv relationship curve between the grayscale and the luminance of the sub pixel area S are obtained, and a singular point appearing in the Gm-Lv relationship curve and the Gs-Lv relationship curve is processed by adopting a Locally weighted regression scatter plot smoothing.

After step S106, a Gm-Lv relationship curve between the grayscale and the luminance of the main pixel area M and a Gs-Lv relationship curve between the grayscale and the luminance of the sub pixel area S are obtained, and a singular point appearing in the Gm-Lv relationship curve and the Gs-Lv relationship curve is processed by adopting a power function fitting process.

An expression of the power function is: f=m*x^n+k.

Another aspect of the present invention provides a liquid crystal display comprising backlight module and a liquid crystal panel which are oppositely disposed, wherein the backlight module provide a display light source to the liquid crystal panel so that the liquid crystal panel displays an image, the liquid crystal panel includes a plurality of pixel units, each pixel unit includes a main pixel area M and a sub pixel area S, and the area ratio of the main pixel area M and the sub pixel area S is a:b, wherein the liquid crystal sets grayscale value by using the above method.

Advantageous Effects

The liquid crystal display provided by the embodiments of the present invention divides each pixel unit into a main pixel area and a sub pixel area with different areas, different display luminance and slant view luminance are generated through inputting different data signals (different grayscale values) to the main pixel area and the sub pixel area so as to reduce color shift generated during side viewing or slant viewing. The gamma curves obtained in the case where the main pixel area M and the sub pixel area S are in the front view angle and the slant view angle both approach gamma (γ)=2.2 by setting grayscales of the main pixel area and the sub pixel area according to the grayscale value setting method provided by the embodiments of the present invention, an excellent display effect can be achieved while reducing color shift, and light leak and color shift at a large view angle are reduced while ensuring the display effect at the front view angle not to be apparently varied.

MODES OF CARRYING OUT THE INVENTION

Below the embodiments are described in detail with reference to the embodiments and the accompanying drawings in order to better explain the technical features and the structures of the present invention.

Figure 1:
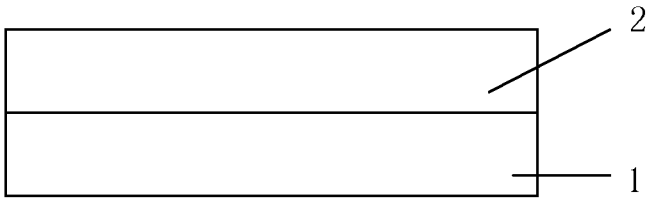
FIG. 1 is a structure diagram of a liquid crystal display provided by an embodiment of the present invention.
Figure 2:
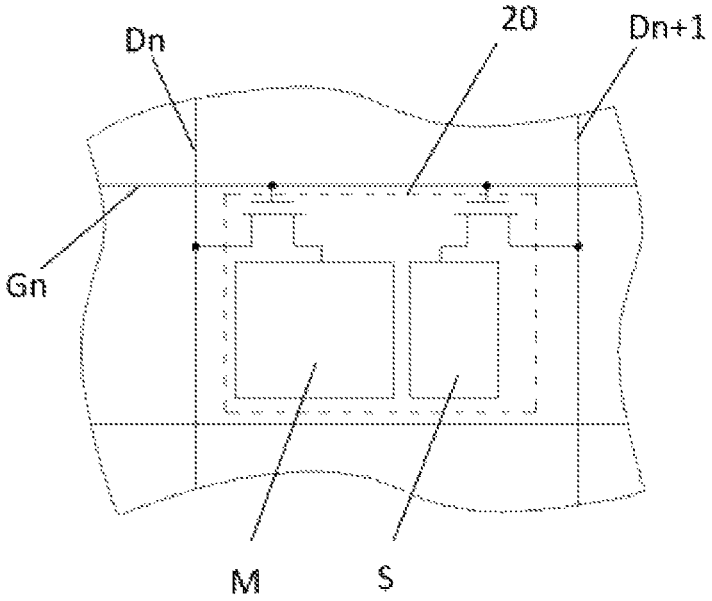
FIG. 2 is a diagram of a part of pixel units of a liquid crystal panel provided by an embodiment of the present invention.

FIG. 1 is a structure diagram of a liquid crystal display provided by the present embodiment; FIG. 2 is a diagram of a part of pixel units of a liquid crystal panel provided by the present embodiment. Referring to FIGS. 1 and 2, the liquid crystal display provided by the present embodiment includes backlight module 1 and a liquid crystal panel 2, which are oppositely disposed, the backlight module 1 provides a display light source to the liquid crystal panel 2 so that the liquid crystal panel 2 displays an image. Wherein, the liquid crystal panel 2 includes a plurality of pixel units 20, each of the pixel units 20 includes a main pixel area M and a sub pixel area S, and an area ratio of the main pixel area M and the sub pixel area S is a:b.

As illustrated in FIG. 2, the main pixel area M and the sub pixel area S in the same one pixel unit 20 are connected to different data lines Dn and Dn+1 and the same scan line Gn, data signals of different grayscale values are provided to the main pixel area M and the sub pixel area S through data lines Dn and Dn+1, respectively, a scan signal is provided to the main pixel area M and the sub pixel area S through the scan line Gn, that is, the main pixel area M and the sub pixel area S in the same one pixel unit 20 are enabled by the same scan signal.

In the liquid crystal display as above provided, different display luminance and slant view luminance are generated through inputting different data signals (different grayscale values) to the main pixel area and the sub pixel area so as to reduce color shift generated during side viewing or slant viewing.

Figure 3:
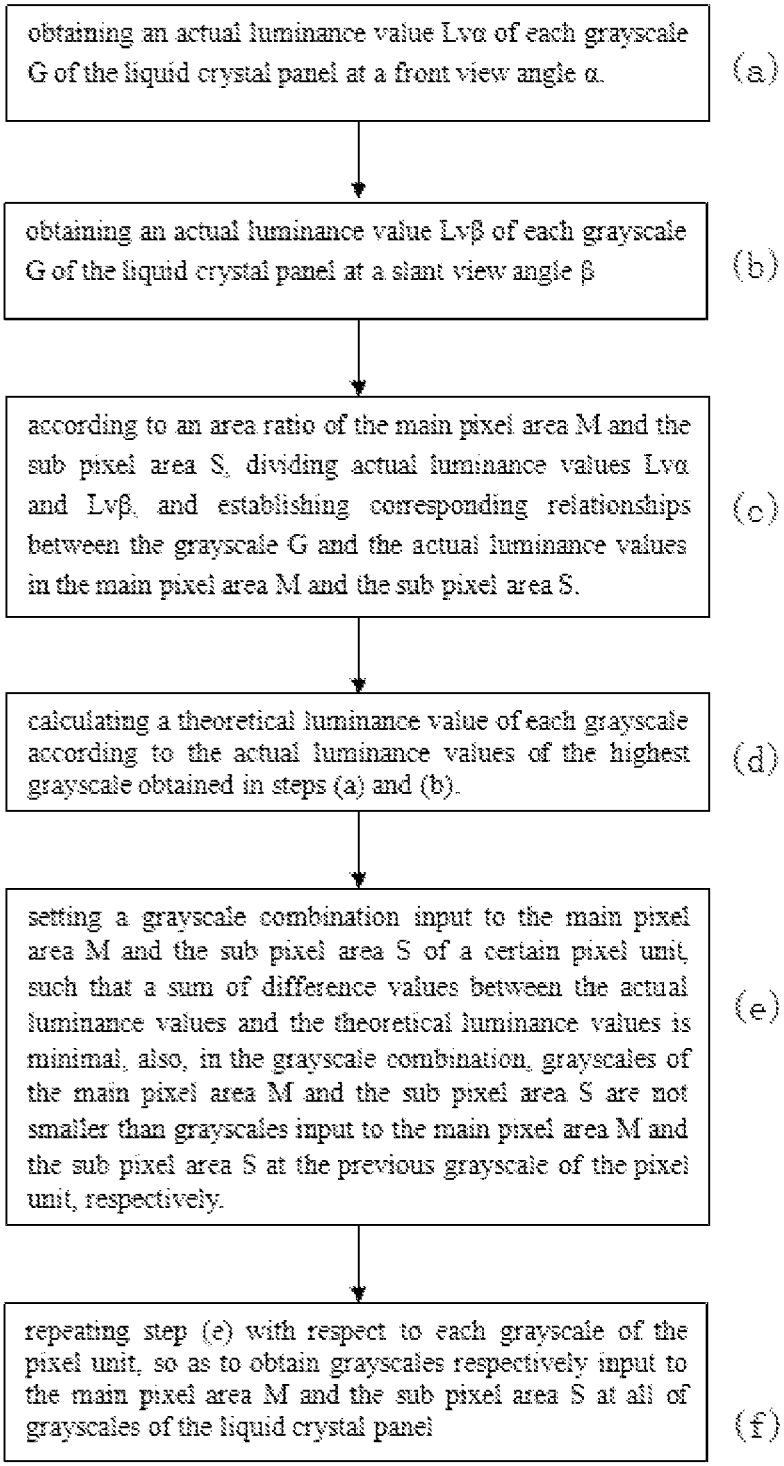
FIG. 3 is a flowchart of a grayscale value setting method provided by an embodiment of the present invention.

As for the liquid crystal display as above provided, the present embodiment provides a grayscale value setting method mainly for setting grayscale values of the main pixel area M and the sub pixel area S, respectively. As illustrated in the flowchart of FIG. 3, the method includes:

(a) An actual luminance value Lvα of each grayscale G of the liquid crystal panel at a front view angle α is obtained.

(b) An actual luminance value Lvβ of each grayscale G of the liquid crystal panel at a slant view angle β is obtained.

(c) According to the area ratio of the main pixel area M and the sub pixel area S, actual luminance values Lvα and Lvβ are divided, and a corresponding relationship between the grayscale G and the actual luminance values in the main pixel area M and the sub pixel area S is established. The dividing is performed according to the following equations:

$$LvM\alpha:LvS\alpha=a:b, LvM\alpha+LvS\alpha=Lv\alpha;$$

$$LvM\beta: LvS\beta=a:b, LvM\beta+LvS\beta=Lv\beta;$$

wherein, actual luminance values LvMα and LvMβ of each grayscale G of the main pixel area M at the front view angle α and the slant view angle β, respectively are obtained; actual luminance values LvSα and LvSβ of each grayscale G of the sub pixel area S at the front view angle α and the slant view angle β are obtained, respectively.

(d) A theoretical luminance value of each grayscale is calculated according to the actual luminance values of the highest grayscale obtained in steps (a) and (b). For example, theoretical luminance values LvGα and LvGβ of each grayscale G of the liquid crystal panel at the front view angle α and the slant view angle β are obtained according to the actual luminance values Lvα(max) and Lvβ(max) of the highest grayscale max, in conjunction with following equations:

$$\text{gamma}(\gamma) = 2.2 \text{ and } \left(\frac{G}{\max}\right)^{\gamma} = \frac{LvG}{Lv(\max)};$$

(e) A grayscale combination to be input to the main pixel area M and the sub pixel area S of a certain pixel unit is set, such that a sum of difference values between actual luminance values and theoretical luminance values is minimal, also, in the grayscale combination, grayscales of the main pixel area M and the sub pixel area S are not smaller than grayscales input to the main pixel area M and the sub pixel area S at the previous grayscale of the pixel unit, respectively. Particularly, as for a grayscale Gx in the pixel unit, supposing that grayscales input to the main pixel area M and the sub pixel area S are Gmx and Gsx, respectively, actual luminance values LvMxα, LvMxβ, LvSxα and LvSxβ are obtained according to the result of step (c), and theoretical luminance values LvGxα and LvGxβ are obtained according to the result of step (d); grayscales needed to be input to the main pixel area M and the sub pixel area S in the previous grayscale G(x−1) of the pixel unit are Gm(x−1) and Gs(x−1), respectively; and the following equations are calculated:

$$\Delta 1=LvMx\alpha+LvSx\alpha-LvGx\alpha;$$

$$\Delta 2=LvMx\beta+LvSx\beta-LvGx\beta;$$

$$y=\Delta 1^2+\Delta 2^2;$$

and a judgment is made:

$$Gmx\geq Gm(x-1), Gsx\geq Gs(x-1);$$

when the condition Gmx≥Gm(x−1), Gsx≥Gs(x−1) is satisfied and y is minimal, corresponding grayscales Gmx and Gsx are set to be the grayscales respectively input to the main pixel area M and the sub pixel area S when the pixel unit is at the grayscale Gx.

(f) step (e) is repeated with respect to each grayscale of the pixel unit, so that grayscales respectively input to the main pixel area M and the sub pixel area S at all of grayscales of the liquid crystal panel are obtained.

In the present embodiment, the front view angle α is 0°, and the slant view angle β is 60°. In some other embodiments, the slant view angle β may also be selected in a range from 30-80°. Wherein, the front view angle indicates a front view angle direction of the liquid crystal display, and the slant view angle indicates an angle formed opposite to the front view angle direction of the liquid crystal display.

In the present embodiment, grayscales of the liquid crystal panel include 256 grayscales from 0-255, wherein the highest grayscale max is grayscale 255.

As a detailed example, the area ratio of the main pixel area M and the sub pixel area S is a:b=2:1, the front view angle α=0°, and the slant view angle β=60°.

Figure 4:
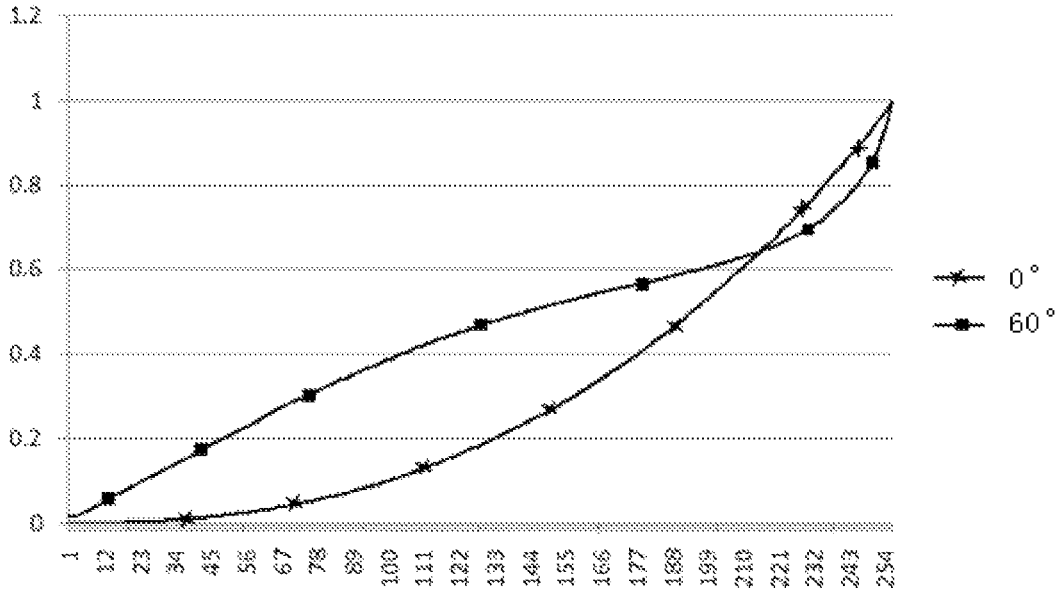
FIG. 4 is a diagram illustrating gamma curve of a liquid crystal panel before grayscale adjustment provided by an embodiment of the present invention.

First, gamma curves of the liquid crystal panel at the front view angle 0° and the slant view angle 60° are obtained, as illustrated in FIG. 4. Actual luminance values Lv0 (0-255) and Lv60 (0-255) of each grayscale G (0-255) at the front view angle 0° and the slant view angle 60° are determined according to the gamma curve.

Then, actual luminance values Lv0 and Lv60 are divided into LvM0, LvS0, LvM60 and LvS0 according to the area ratio of the main pixel area M and the sub pixel area S, namely, a:b=2:1, and LvM0, LvS0, LvM60 and LvS0 satisfy the following conditions:

$$LvM0:LvS0=2:1, LvM0+LvS0=Lv0;$$

$$LvM60:LvS60=2:1, LvM60+LvS60=Lv60;$$

actual luminance values LvM0(0-255) and LvM60(0-255) of each grayscale G (0-255) of the main pixel area M at the front view angle 0° and the slant view angle 60° are obtained; actual luminance values LvS0(0-255) and LvS60 (0-255) of each grayscale G (0-255) of the sub pixel area S at the front view angle 0° and the slant view angle 60° are obtained, and corresponding relationships between the grayscale G and the actual luminance values in the main pixel area M and the sub pixel area S are established.

Further, according to actual luminance values Lv0(255) and Lv60(255) of the highest grayscale 255, in conjunction with equations:

$$\text{gamma}(\gamma) = 2.2 \text{ and } \left(\frac{G}{255}\right)^{\gamma} = \frac{LvG}{Lv(255)},$$

theoretical luminance values LvG0(0-255) and LvG60(0-255) of each grayscale G (0-255) of the liquid crystal panel at the front view angle 0° and the slant view angle 60° are calculated and corresponding relationship between the grayscale G and the theoretical luminance values are established.

Further, as for a grayscale Gx (Gx is one of 0-255) in the pixel unit, supposing that grayscales input to the main pixel area M and the sub pixel area S are Gmx and Gsx, respectively, actual luminance values LvMx0, LvMx60, LvSx0 and LvSx60 corresponding to grayscales Gmx and Gsx are obtained according to the previously established corresponding relationships between the grayscale G and the actual luminance values in the main pixel area M and the sub pixel area S, theoretical luminance values LvGx0 and LvGx60 corresponding to the grayscale Gx are obtained according to the previously established corresponding relationship between the grayscale G and the theoretical luminance values; and the following equations are calculated:

$$\Delta 1=LvMx0+LvSx0-LvGx0;$$

$$\Delta 2=LvMx60+LvSx60-LvGx60;$$

$$y=\Delta 1^2+\Delta 2^2;$$

through attempts of selecting combination of values of Gmx and Gsx, when a combination of values of Gmx and Gsx makes y in the above equation to be minimal, grayscales Gmx and Gsx at this time are set to be grayscales respectively input to the main pixel area M and the sub pixel area S when the pixel unit is at the grayscale Gx.

Figure 5:
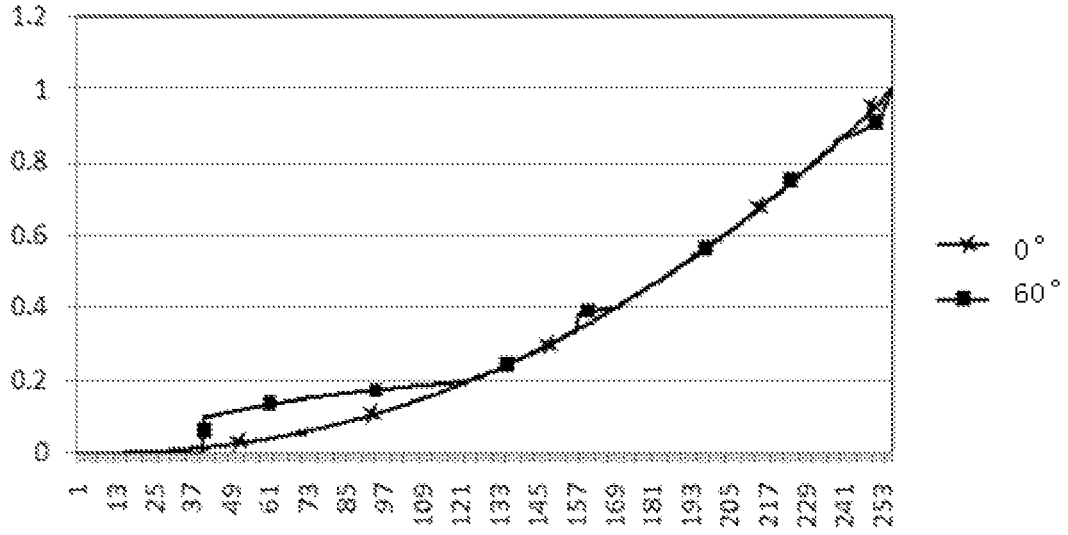
FIG. 5 is a diagram illustrating gamma curve of a liquid crystal panel after grayscale adjustment provided by an embodiment of the present invention.

Finally, the above step is repeated with respect to each grayscale G (0-255) of the pixel unit, so that grayscales respectively input to the main pixel area M and the sub pixel area S at all of grayscales (0-255) of the liquid crystal panel are finally obtained.

gamma curves of the liquid crystal panel at the front view angle 0° and the slant view angle 60° are illustrated in FIG. 5 through adjustment of grayscales of the main pixel area M and the sub pixel area S in the present embodiment. The gamma curves obtained in the case where the main pixel area M and the sub pixel area S are in the front view angle and the slant view angle are both approaching gamma(γ) =2.2 by setting grayscales of the main pixel area M and the sub pixel area S, and an excellent display effect can be achieved while reducing color shift.

Figure 6:
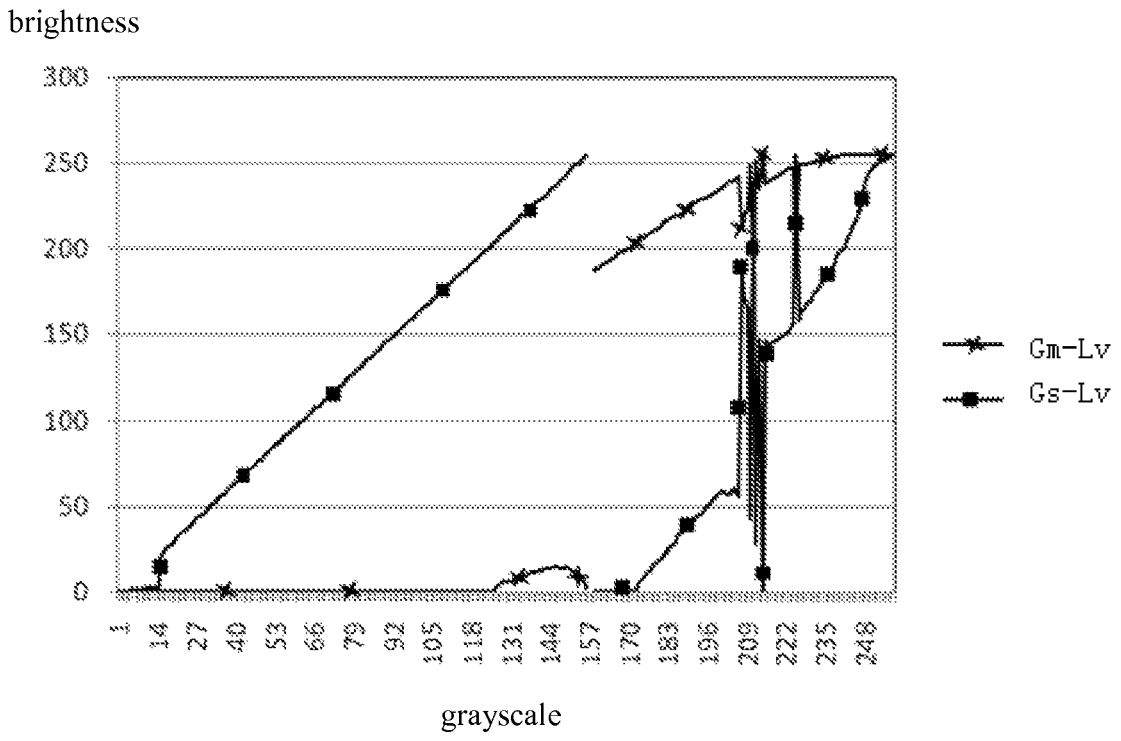
FIG. 6 is a relationship curve between a grayscale and a luminance after grayscale adjustment in an embodiment of the present invention.

FIG. 6 illustrates a Gm-Lv relationship curve between the grayscale and the luminance of the main pixel area M and a Gs-Lv relationship curve between the grayscale and the luminance of the sub pixel area S after the setting according to the above steps. In the relationship curves as illustrated in FIG. 6, a grayscale inversion occurs around grayscale 157, and there are many singular discrete numerical points on the curve, which affects display quality of the liquid crystal display.

Figure 7:
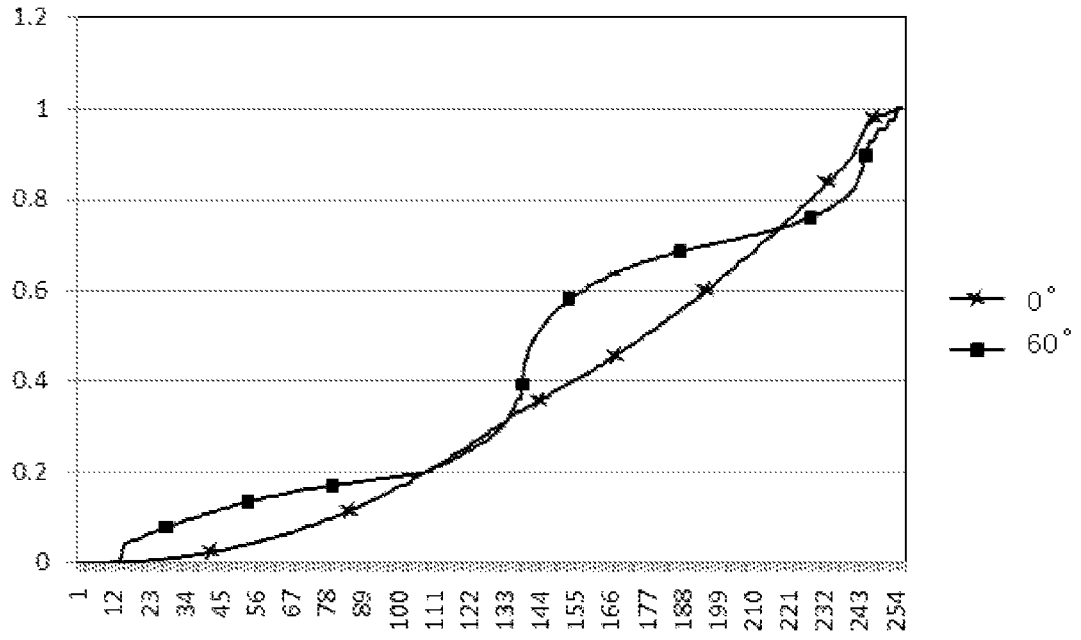
FIG. 7 is a diagram illustrating gamma curve of a liquid crystal panel after grayscale adjustment provided by another embodiment of the present invention.

In order to solve this problem, a comparison condition is added to the step of setting grayscales Gmx and Gsx input to the main pixel area M and the sub pixel area S. For example, as for a grayscale Gx (for example, grayscale 100) in the pixel unit, assuming that grayscales input to the main pixel area M and the sub pixel area S are Gmx and Gsx, respectively, grayscales needed to be input to the main pixel area M and the sub pixel area S of the previous grayscale G(x−1) (grayscale 99) of the pixel unit are Gm(x−1) and Gs(x−1), respectively;

during calculation of the following equations, $$\Delta 1 = LvMx\alpha + LvSx\alpha - LvGx\alpha;$$

$$\Delta 2 = LvMx\beta + LvSx\beta - LvGx\beta;$$

$$y = \Delta 1^2 + \Delta 2^2;$$

a judgment condition is added:

$$Gmx \geq Gm(x-1), Gsx \geq Gs(x-1);$$

when the condition Gmx≥Gm(x−1), Gsx≥Gs(x−1) is satisfied and y is a minimal, the corresponding grayscales Gmx and Gsx are set to be grayscales respectively input to the main pixel area M and the sub pixel area S when the pixel unit is at the grayscale Gx. After adding the above judgment condition, gamma curves of the liquid crystal panel at the front view angle 0° and the slant view angle 60° are illustrated in FIG. 7.

Since the judgment condition is added, as for a pixel unit, grayscales input to the main pixel area M and the sub pixel area S at a grayscale are respectively not smaller than grayscales input to the main pixel area M and the sub pixel area S at a previous grayscale of the pixel unit, so that there is no singular point in the finally obtained relationship curve between the grayscale and the luminance, and a smooth curve is obtained, which modifies errors appearing in initial calculation.

Figure 8:
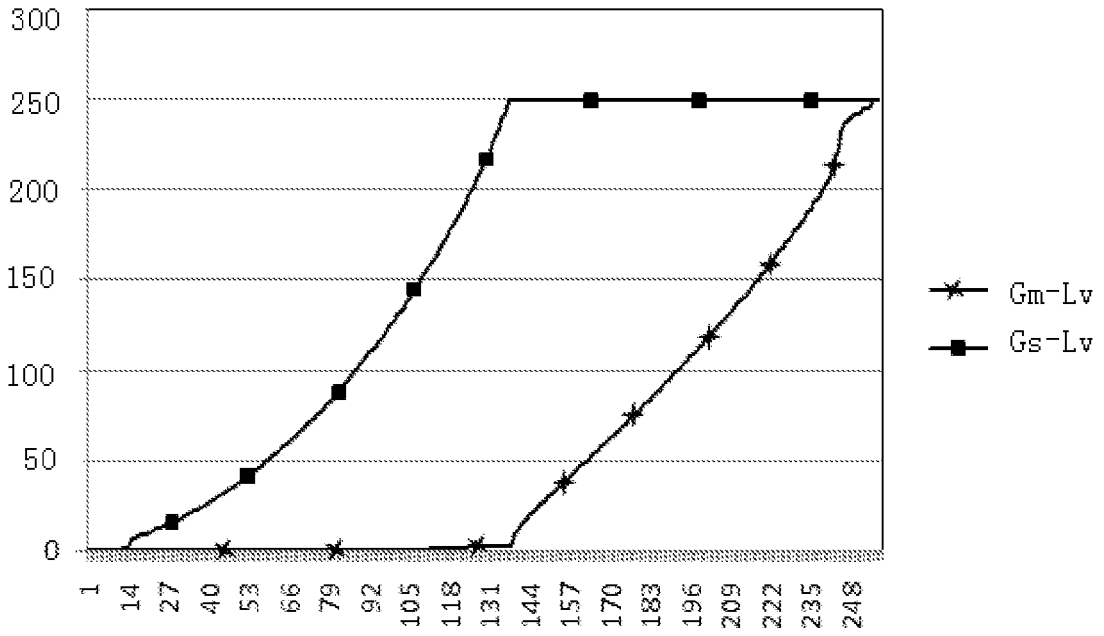
FIG. 8 is a relationship curve between a grayscale and a luminance after grayscale adjustment in another embodiment of the present invention.

FIG. 8 illustrates a Gm-Lv relationship curve between the grayscale and the luminance of the main pixel area M and a Gs-Lv relationship curve between the grayscale and the luminance of the sub pixel area S after the setting according to the above steps with the judgment condition added. It can be seen from FIG. 8 that Gm-Lv curve and Gs-Lv curve are smooth curves, wherein, the luminance of the sub pixel area S is saturate after grayscale 135, hence, setting the grayscale value according to the present embodiment may improve display quality of the liquid crystal display.

To sum up, the liquid crystal display provided by the embodiments of the present invention divides each pixel unit into the main pixel area and the sub pixel area with different areas, different display luminance and slant view luminance are generated through inputting different data signals (different grayscale values) to the main pixel area and the sub pixel area so as to reduce color shift generated during side viewing or slant viewing. The gamma curves obtained in the case where the main pixel area M and the sub pixel area S are in the front view angle and the slant view angle both approach gamma(γ)=2.2 by setting grayscales of the main pixel area and the sub pixel area according to the grayscale value setting method provided by the embodiments of the present invention, an excellent display effect can be achieved while reducing color shift, and light leak and color shift at a large view angle are reduced while ensuring the display effect at the front view angle not to be apparently varied.

Obviously, the protection scope of the present invention is not limited to the above detailed modes, and those skilled in the art may make various changes and modifications to the invention without departing from the scope and spirit of the invention. As such, if these changes and modifications of the present invention belong to the scope of the claims of the present invention and equivalent technologies thereof, the present invention also intends to include these changes and modifications here.

The invention claimed is:

1. A grayscale value setting method for a liquid crystal panel comprising a plurality of pixel units, each of which comprises a main pixel area M and a sub pixel area S, wherein, an area ratio of the main pixel area M and the sub pixel area S is a:b, the method comprising:

S101 obtaining an actual luminance value Lvα of each grayscale G of the liquid crystal panel at a front view angle α;

S102 obtaining an actual luminance value Lvβ of each grayscale G of the liquid crystal panel at a slant view angle β;

S103 according to the area ratio of a:b of the main pixel area M and the sub pixel area S, dividing the actual luminance values Lvα and Lvβ according to following equations:

$$LvM\alpha : LvS\alpha = a:b, LvM\alpha + LvS\alpha = Lv\alpha;$$

$$LvM\beta : LvS\beta = a:b, LvM\beta + LvS\beta = Lv\beta;$$

wherein, actual luminance values LvMα and LvMβ of each grayscale G of the main pixel area M at the front view angle α and the slant view angle β are obtained, respectively; actual luminance values LvSα and LvSβ of each grayscale G of the sub pixel area S at the front view angle α and the slant view angle β are obtained, respectively;

S104 calculating theoretical luminance values LvGα and LvGβ of each grayscale G of the liquid crystal panel at the front view angle α and the slant view angle β according to actual luminance values Lvα(max) and Lvβ(max) of a highest grayscale max obtained in steps S101 and S102, in conjunction with equations:

$$\text{gamma}(\gamma) = 2.2 \text{ and } \left(\frac{G}{\max}\right)^{\gamma} = \frac{LvG}{Lv(\max)};$$

S105 as for a grayscale Gx in the pixel unit, assuming that grayscales input to the main pixel area M and the sub pixel area S are Gmx and Gsx, respectively, obtaining actual luminance values LvMxα, LvMxβ, LvSxα and LvSxβ according to a result of S103, and obtaining theoretical luminance values LvGxα and LvGxβ according to a result of S104; and calculating following equations:

$$\Delta 1 = LvMx\alpha + LvSx\alpha - LvGx\alpha;$$

$$\Delta 2 = LvMx\beta + LvSx\beta - LvGx\beta;$$

$$y = \Delta 1^2 + \Delta 2^2;$$

and judging:

$$Gmx \geq Gm(x-1), Gsx \geq Gs(x-1);$$

wherein, when the condition Gmx≥Gm(x−1), Gsx≥Gs(x−1) is satisfied and y is minimal, corresponding grayscales Gmx and Gsx are set to be grayscales respectively input to the main pixel area M and the sub pixel area S when the pixel unit is at the grayscale Gx; and S106 repeating S105 with respect to each grayscale G of the pixel unit, so as to obtain grayscales respectively input to the main pixel area M and the sub pixel area S at all of grayscales of the liquid crystal panel.

2. The grayscale value setting method for the liquid crystal panel in claim 1, wherein the front view angle α is 0°, and the slant view angle β is 30-80°.

3. The grayscale value setting method for the liquid crystal panel in claim 2, wherein the slant view angle β is 60°.

4. The grayscale value setting method for the liquid crystal panel in claim 1, wherein grayscales of the liquid crystal panel include 256 grayscales from 0-255, wherein the highest grayscale max is grayscale 255.

5. The grayscale value setting method for the liquid crystal panel in claim 2, wherein grayscales of the liquid crystal panel include 256 grayscales from 0-255, wherein the highest grayscale max is grayscale 255.

6. The grayscale value setting method for the liquid crystal panel in claim 1, wherein the obtaining of the actual luminance value Lvα of each grayscale G of the liquid crystal panel at the front view angle α comprises:

obtaining a gamma curve of the liquid crystal panel at the front view angle α; and determining the actual luminance value Lvα according to the gamma curve.

7. The grayscale value setting method for the liquid crystal panel in claim 1, wherein the obtaining of the actual luminance value Lvα of each grayscale G of the liquid crystal panel at the slant view angle α comprises:

obtaining a gamma curve of the liquid crystal panel at the slant view angle β; and determining the actual luminance value Lvα according to the gamma curve.

8. The grayscale value setting method for the liquid crystal panel in claim 1, wherein, after step S106, a Gm-Lv relationship curve between the grayscale and the luminance of the main pixel area M and a Gs-Lv relationship curve between the grayscale and the luminance of the sub pixel area S are obtained, and a singular point appearing in the Gm-Lv relationship curve and the Gs-Lv relationship curve is processed by adopting a Locally weighted regression scatter plot smoothing.

9. The grayscale value setting method for the liquid crystal panel in claim 1, wherein, after step S106, a Gm-Lv relationship curve between the grayscale and the luminance of the main pixel area M and a Gs-Lv relationship curve between the grayscale and the luminance of the sub pixel area S are obtained, and a singular point appearing in the Gm-Lv relationship curve and the Gs-Lv relationship curve is processed by adopting a power function fitting process.

10. The grayscale value setting method for the liquid crystal panel in claim 9, wherein an expression of the power function is: f=m*x^n+k.

11. A liquid crystal display comprising backlight module and a liquid crystal panel which are oppositely disposed, wherein the backlight module provide a display light source to the liquid crystal panel so that the liquid crystal panel displays an image, the liquid crystal panel includes a plurality of pixel units, each pixel unit includes a main pixel area M and a sub pixel area S, and the area ratio of the main pixel area M and the sub pixel area S is a:b, wherein a grayscale value setting method of the liquid crystal panel comprises:

S101 obtaining an actual luminance value Lvα of each grayscale G of the liquid crystal panel at a front view angle α;

S102 obtaining an actual luminance value Lvβ of each grayscale G of the liquid crystal panel at a slant view angle β;

S103 according to the area ratio of a:b of the main pixel area M and the sub pixel area S, dividing the actual luminance values Lvα and Lvβ according to following equations:

$$LvM\alpha : LvS\alpha = a:b, LvM\alpha + LvS\alpha = Lv\alpha;$$

$$LvM\beta : LvS\beta = a:b, LvM\beta + LvS\beta = Lv\beta;$$

wherein, actual luminance values LvMα and LvMβ of each grayscale G of the main pixel area M at the front view angle α and the slant view angle β are obtained, respectively; actual luminance values LvSα and LvSβ of each grayscale G of the sub pixel area S at the front view angle α and the slant view angle β are obtained, respectively;

S104 calculating theoretical luminance values LvGα and LvGβ of each grayscale G of the liquid crystal panel at the front view angle α and the slant view angle β according to actual luminance values Lvα(max) and Lvβ(max) of a highest grayscale max obtained in steps S101 and S102, in conjunction with equations:

$$\text{gamma}(\gamma) = 2.2 \text{ and } \left(\frac{G}{\max}\right)^{\gamma} = \frac{LvG}{Lv(\max)};$$

S105 as for a grayscale Gx in the pixel unit, assuming that grayscales input to the main pixel area M and the sub pixel area S are Gmx and Gsx, respectively, obtaining actual luminance values LvMxα, LvMxβ, LvSxα and LvSxβ according to a result of S103, and obtaining theoretical luminance values LvGxα and LvGxβ according to a result of S104; and calculating following equations:

$$\Delta 1 = LvMx\alpha + LvSx\alpha - LvGx\alpha;$$

$$\Delta 2 = LvMx\beta + LvSx\beta - LvGx\beta;$$

$y=\Delta 1^2+\Delta 2^2$;

and judging:

$Gmx \geq Gm(x-1), Gsx \geq Gs(x-1)$;

wherein, when the condition Gmx≥Gm(x−1), Gsx≥Gs(x−1) is satisfied and y is minimal, corresponding grayscales Gmx and Gsx are set to be grayscales respectively input to the main pixel area M and the sub pixel area S when the pixel unit is at the grayscale Gx; and S106 repeating S105 with respect to each grayscale G of the pixel unit, so as to obtain grayscales respectively input to the main pixel area M and the sub pixel area S at all of grayscales of the liquid crystal panel.

12. The liquid crystal display in claim 11, wherein the front view angle α is 0°, and the slant view angle β is 30-80°.

13. The liquid crystal display in claim 12, wherein the slant view angle β is 60°.

14. The liquid crystal display in claim 11, wherein grayscales of the liquid crystal panel includes 256 grayscales from 0-255, wherein the highest grayscale max is grayscale 255.

15. The liquid crystal display in claim 12, wherein grayscales of the liquid crystal panel includes 256 grayscales from 0-255, wherein the highest grayscale max is grayscale 255.

16. The liquid crystal display in claim 11, wherein the obtaining of the actual luminance value Lvα of each grayscale G of the liquid crystal panel at the front view angle α comprises:

obtaining a gamma curve of the liquid crystal panel at the front view angle α; and determining the actual luminance value Lvα according to the gamma curve.

17. The liquid crystal display in claim 11, wherein the obtaining of the actual luminance value Lvβ of each grayscale G of the liquid crystal panel at the slant view angle β comprises:

obtaining the gamma curve of the liquid crystal panel at the slant view angle β; and determining the actual luminance value Lvα according to the gamma curve.

18. The liquid crystal display in claim 11, wherein after completing S106, a Gm-Lv relationship curve between the grayscale and the luminance of the main pixel area M and a Gs-Lv relationship curve between the grayscale and the luminance of the sub pixel area S are obtained, a singular point appearing in the Gm-Lv relationship curve and the Gs-Lv relationship curve is processed by adopting a Locally weighted regression scatter plot smoothing.

19. The liquid crystal display in claim 11, wherein, after completing S106, a Gm-Lv relationship curve between the grayscale and the luminance of the main pixel area M and a Gs-Lv relationship curve between the grayscale and the luminance of the sub pixel area S are obtained, a singular point appearing in the Gm-Lv relationship curve and the Gs-Lv relationship curve is processed by adopting a power function fitting process.

20. The liquid crystal display in claim 19, wherein an expression of the power function is: f=m*x^n+k.

* * * * *